United States Patent [19]

Shiomi

[11] Patent Number: 4,706,587

[45] Date of Patent: Nov. 17, 1987

[54] PRESSER FOOT LIFTER IN SEWING MACHINE

[75] Inventor: Kengo Shiomi, Tokyo, Japan

[73] Assignee: Tokyo Juki Industrial Co., Ltd., Tokyo, Japan

[21] Appl. No.: 804,637

[22] PCT Filed: Mar. 28, 1984

[86] PCT No.: PCT/JP84/00140

§ 371 Date: Nov. 19, 1985

§ 102(e) Date: Nov. 19, 1985

[87] PCT Pub. No.: WO85/04430

PCT Pub. Date: Oct. 10, 1985

[51] Int. Cl.[4] ..... D05B 29/00

[52] U.S. Cl. ..... 112/237

[58] Field of Search ..... 112/238, 239, 237

[56] References Cited

U.S. PATENT DOCUMENTS 3,353,511 11/1967 Marino ..... 112/237

3,601,072 8/1971 Husted ..... 112/239 X 4,246,856 1/1981 Sansone et al. ..... 112/239

4,388,886 6/1983 Adams ..... 112/237

FOREIGN PATENT DOCUMENTS 4434 1/1980 Japan ..... 112/239

*Primary Examiner*—H. Hampton Hunter

*Attorney, Agent, or Firm*—Tarolli, Sundheim & Covell

[57] ABSTRACT

This invention relates to a presser foot lifter in a sewing machine. The presser foot lifter comprises a pressure relief mechanism for lessening the force of a spring means adapted to bias a presser foot towards a throat plate, a presser foot drive mechanism for lifting the presser foot and a manual operation mechanism operable by the operator. When the operation mechanism is actuated, the pressure relief mechanism operates to lessen the force of the spring means and the presser foot drive mechanism operates to lift the presser foot. According to the present invention, the presser foot can be lifted to any desired height.

8 Claims, 4 Drawing Figures

PRESSER FOOT LIFTER IN SEWING MACHINE

FIELD OF ART

This invention relates to a presser foot lifter in a sewing machine and more particularly, to a presser foot lifter in a sewing machine which is capable of lifting the presser foot adapted to hold a workpiece or workpieces such as a piece or pieces of cloth to be sewn against the throat plate at any desired height with a small force.

BACKGROUND OF THE INVENTION

Hithertofore, in conventional presser foot lifters in sewing machines of the type referred to hereinabove, as shown in FIG. 1, the presser foot 3 is held against the throat plate 2 by means of the presser bar spring 1 comprising a compression spring and is lifted to a predetermined height against the force of the presser bar spring when the solenoid 4 is excited. That is, in the lifter of FIG. 1, when the knee-operated switch 6 embedded in the knee abutment member 5 is switched on by the operator's knee, the solenoid 4 is excited to rotate the knee-operated lifting lever 7 in the counterclockwise or arrowed direction which in turn lifts the presser rod 9 which is slidable within the oil sump 8. As the lifter rod 9 is lifted, the bar 10 is lifted to rotate the lever 11 in the clockwise or arrowed direction which in turn moves the connector rod 12 rightwards or in the arrowed direction to rotate the lever 13 in the clockwise direction. As the lever 13 rotates in the clockwise direction, the lever abuts against and upwardly pushes the stop rod 15 secured to the presser bar 14 having the presser foot 3 secured to the lower end thereof. Thus, as the stop rod 15 is pushed upwardly, the presser bar 14 is lifted against the force of the presser bar spring 1 whereby the presser foot 3 is lifted away from the throat plate 2.

However, in the above-mentioned conventional presser foot lifter, since the presser foot is designed to be lifted by the excitation of the solenoid, although the operator can lift the presser foot with a small force, the conventional presser foot lifter has the disadvantage that the presser foot 3 is allowed to move between only two positions, that is, the lowermost position in which the presser foot 3 contacts the throat plate 2 and the uppermost position far above the throat plate, and cannot be lifted to a position above the throat plate by a small distance or a position convenient for the operator to operate the lifter.

DISCLOSURE OF THE INVENTION

The present invention has as its object the provision of a presser foot lifter for a sewing machine which can eliminate the disadvantages inherent in the conventional sewing machine presser foot lifter referred to hereinabove. That is, the present invention intends to enable the presser foot to be lifted to any desired position above the throat plate with a small force.

In order to attain this object, the presser foot lifter for a sewing machine includes a pressure relief mechanism adapted to lessen the force of a spring means which normally biases the presser foot towards the throat plate, a presser foot driving mechanism for lifting the presser foot and an operation mechanism operable by the operator. Upon the actuation of the operation mechanism, the pressure relief mechanism is operated to lessen the force of the spring means which urges the presser foot against the throat plate and, after the force of the spring means has thus been lessened, the presser foot driving mechanism is operated by the operation mechanism to drive the presser foot to a desired position above the throat plate.

By virtue of the presser foot lifter of the present invention, since the presser foot can be lifted with a small force, fatigue on the part of the operator can be substantially lessened. And according to the present invention, since the presser foot can be lifted to any desired position above the throat plate, the lifter can be applied to workpieces of various thicknesses to thereby substantially enhance the operating efficiency of the sewing machine.

BEST MODE FOR CARRYING OUT THE INVENTION

Preferred embodiments of the present invention will now be described in detail referring to the accompanying drawings.

Figure 1:
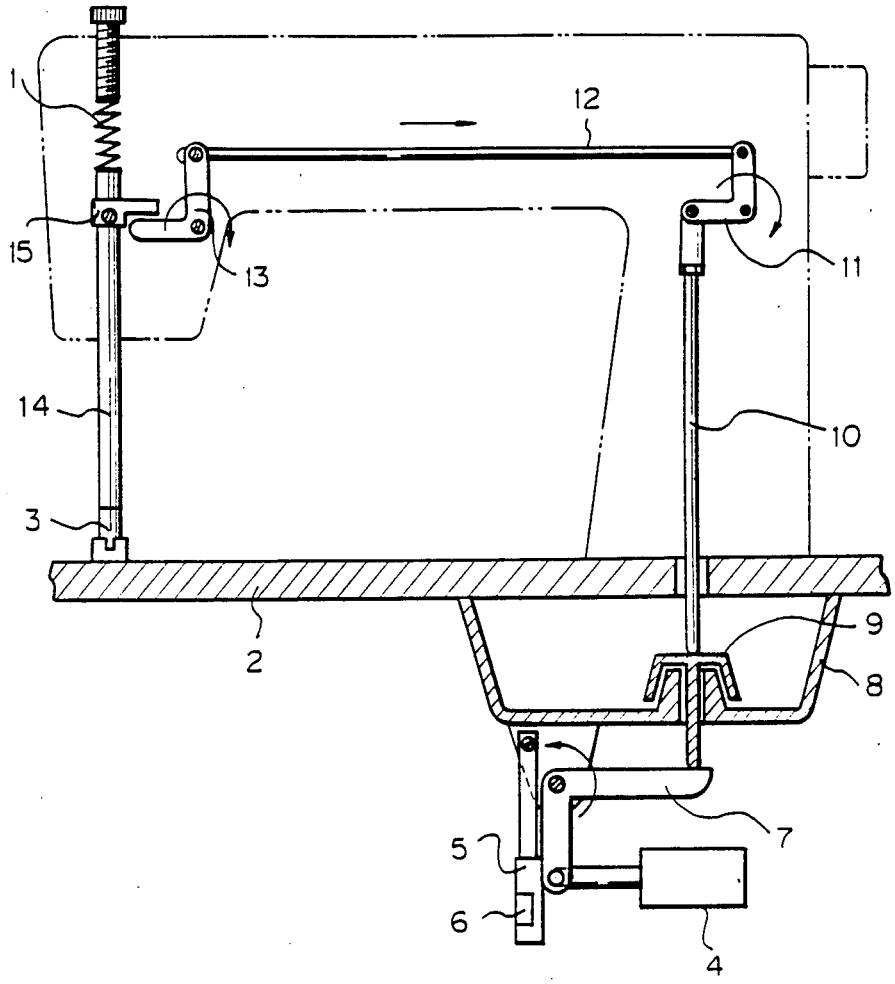
FIG. 1 is an elevational view in partial section of a conventional sewing machine presser foot lifter.
Figure 2:
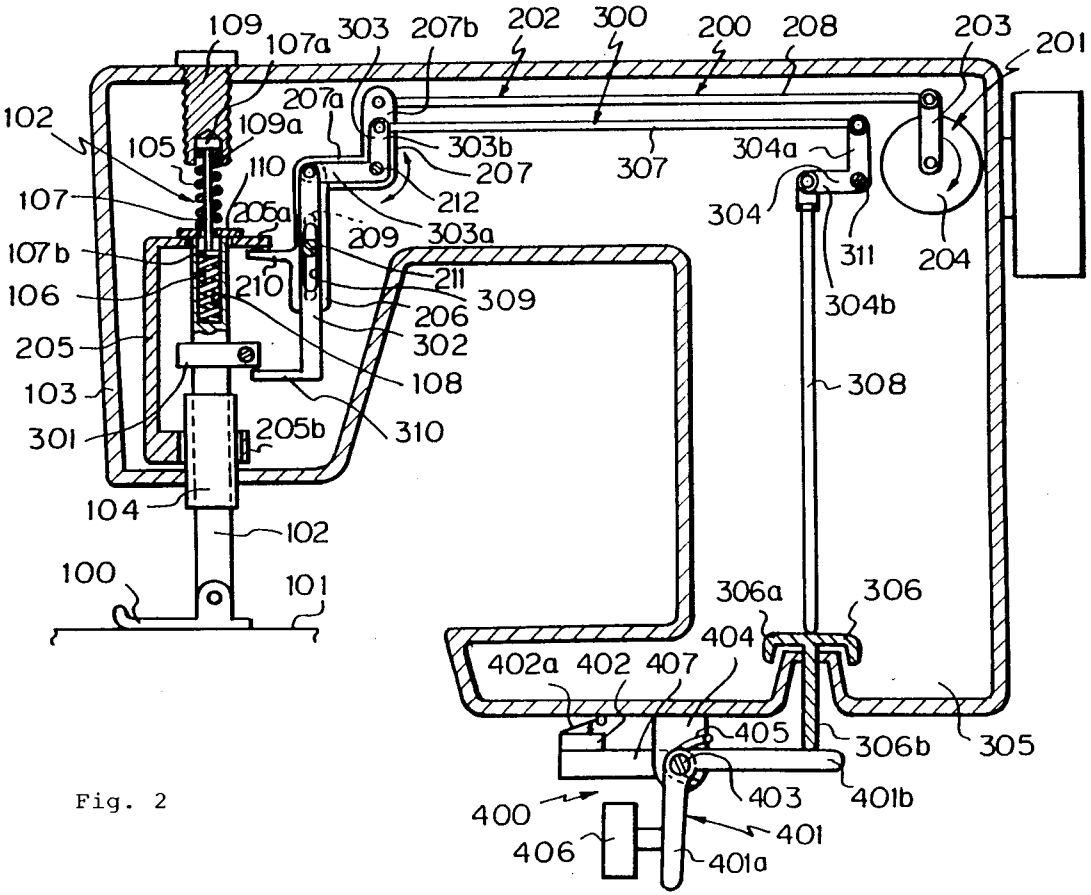
FIG. 2 is an elevational view in partial section of one embodiment of the sewing machine presser foot lifter according to the present invention.

First of all, referring to FIG. 2 in which one embodiment of the sewing machine presser foot lifter according to the present invention is shown, the lifter includes a pressure relief mechanism 200 for lessening the force of a spring means 102 which normally biases the presser foot 100 towards the throat plate 101, a presser foot driving mechanism 300 for lifting the presser foot 100 and a manual operation mechanism 400 operable by the operator.

The presser foot 100 is pivoted to the lower end of the presser bar 102. The presser bar is slidably supported for upward and downward movement within a bearing 104 secured to the frame 103 of the sewing machine. The spring means 102 is disposed on the top of the presser bar to normally urge the presser foot 100 against the upper surface of the throat plate 101 with a suitable force. Although not shown, a workpiece or workpieces to be sewn are pinched between the throat plate and presser foot. In the embodiment shown in FIG. 2, the spring means 102 comprises a presser bar spring 105 and an auxiliary spring 106. The presser bar spring 105 is disposed about a guide bar 107 and the auxiliary spring 106 is received within a recessed bore 108 formed in the upper end portion of the presser bar 102. The upper end **107*a* of the guide bar is received in a recessed bore 109*a* formed in the lower end portion of an adjusting threaded member 109 which is in threaded engagement with the frame 103 and is held in position there, and the lower end 107*b* of the guide bar holds down the upper end of the auxiliary spring 106 within the recessed bore 108 in the presser bar. The presser bar spring 105 contacts the upper end face of the presser bar 102 and is disposed between an annular plate 110 freely disposed about the guide bar and the upper end 107*a* of the guide bar 107**.

The presser bar spring 105 and auxiliary spring 106 have suitable spring forces, but the spring force of the presser bar spring is set to be greater than that of the auxiliary spring.

The pressure relief mechanism 200 comprises a drive means 201 and a link assembly 202 operatively connected to the drive means 201 for preventing the force of the presser bar spring 105 from acting on the presser bar 102. In the embodiment shown in FIG. 2, the drive means comprises a rotary solenoid having the rotary drive shaft 203. The body 204 of the drive means is secured to the machine frame 103. The link assembly 202 comprises a channel member 205 mounted on the presser bar for slidable movement along the bar, a spring lifting rod 206 for engaging the channel member and mounted on the machine frame 103 for upward and downward movement, a bell crank 207 operatively connected to the spring lifting rod 206 and a connector rod 208 connecting the bell crank and the drive shaft 203 of the solenoid. The channel member 205 has an upper arm 205*a* freely received on the presser bar 102 and an lower arm 205*b* freely received on the bearing 104. The spring lifting rod 206 has a vertical slot 209 and a substantially horizontally extending arm 210. Received within the vertical slot 209 is a screw 211 which is screwed in the frame 103. Thus, the spring lifting rod is vertically movable along the slot. The leading end of the arm 210 is disposed adjacent to the undersurface of the upper arm 205*a* of the channel member 205. The bell crank 207 is rotatably attached at the central area thereof to the machine frame 103 by a screw 212. The bell crank has a first arm 207*a* pivoted to the upper end of the spring lifting rod 206 and a second arm 207*b* to which one end of the connector rod 208 is pivoted. The other end of the connector rod is pivoted to the leading end of the drive shaft 203 of the solenoid.

In the illustrated embodiment, the presser foot drive mechanism 300 comprises a link assembly. That is, the presser foot drive mechanism comprises a transverse rod 301 secured to the presser bar 102, a vertically movable presser bar lifting rod 302 engaging the transverse rod, a first bell crank 303 operatively connected to the presser bar lifting rod, a second bell crank 304, a presser rod 306 slidable within an oil pan 305, a first connector rod 307 connecting between the first and second bell cranks 303 and 304 and a second connector rod 308 interposed between the second bell crank 304 and presser rod 306. The presser bar lifting rod 302 has a vertical slot 309 and a horizontal arm 310. The presser bar lifting rod is attached to the machine frame by the screw 211 which also attaches the spring lifting rod 206 to the machine frame. That is, the screw 211 is passed through the slots 309 and 209 in the presser bar lifting rod 302 and spring lifting rod 206, respectively, and is screwed into the machine frame. The arm 310 is disposed adjacent to the undersurface of the transverse rod 201. The first bell crank 303 is rotatably attached at the central area thereof to the machine frame 103 by the screw 212 also attaching the bell crank 207 to the machine frame 103 and has a first arm 303*a* the leading end of which is pivoted to the upper end of the presser bar lifting rod 302 and a second arm 303*b* pivoted to one end of the first connector rod 307. The second bell crank 304 is rotatably attached at the central area thereof to the machine frame 103 by a screw 311 which is screwed in the machine frame. The second bell crank 304 has a first arm 304*a* connected to the other end of the first connector rod 307 and a second arm 304*b* connected to one end of the second connector rod 308. The other end of the second connector rod contacts the head 306*a* of the presser rod 306. The presser rod 306 has a downwardly extending bar 306*b*.

The operation mechanism 400 is designed to be actuated by the operator's knee. The operation mechanism comprises an operation lever 401 for actuating the presser foot drive mechanism 300 and a switch means 402 for actuating the pressure relief mechanism 200. The operation lever 401 is a substantially L-shaped member and is rotatably attached at the central area thereof to a bracket 404 by a screw 403. The operation lever 401 is normally biased in the clockwise direction as seen in FIG. 2 by a coil spring 405. The operation lever has a first arm 401*a* provided with a knee abutment member 406 and a second arm 401*b* contacting the downwardly extending bar 306*b* on the presser rod 306. The switch means 402 may comprise a limit switch, for example, and is adapted to switch the solenoid 204 on and off. The limit switch is secured to the top of a projection rod 407 extending from the operation lever 401 and has a movable contact piece 402*a* which is normally biased to contact the undersurface of the oil pan 305 by a coil spring 405 to maintain the solenoid 204 in its non-excited condition. When the operation lever 401 is rotated in the counterclockwise direction against the force of the coil spring 405, the limit switch disengages from the under-surface of the oil pan to switch the solenoid 204 on. The limit switch may be replaced by a proximity switch, photosensor or the like.

The lifter of the invention described hereinabove operates as follows:

When the operator pushes the knee abutment member 406 by his knee with a slight force, the operation lever 401 rotates in the counterclockwise direction by a small angular distance against the force of the coil spring 405 which in turn rotates the limit switch 402 in the counterclockwise direction to disengage the movable contact piece 40 from the undersurface of the oil pan 305 whereupon the solenoid 201 is excited to rotate the drive shaft 203 in the arrowed or clockwise direction and moves the connector rod 208 rightwards, resulting in the rotation of the bell crank 207 in the clockwise direction. The rotation of the bell crank in the clockwise direction moves the spring lifting rod 206 upwardly until the arm 210 of the rod engages the upper arm 205*a* of the channel member 205 to move the member upwardly which in turn lifts the presser spring 105 through the annular plate 110 against the resilient force of the spring to cause the spring to compress. This, the annular plate 110 disengages from the upper end of the presser bar 102 whereby the resilient force of the presser spring will no longer act on the presser bar. As a result, only the force of the auxiliary spring 106 acts on the presser bar.

As the operation lever 401 is further rotated in the counterclockwise direction, the presser rod 306 moves upwardly to move the second connector rod 308 upwardly. As a result, the second bell crank 304 rotates in the clockwise direction to move the first connector rod 307 rightwards which in turn rotates the first bell crank 303 in the clockwise direction. The rotation of the first bell crank 303 in the clockwise direction moves the presser bar lifting rod 302 upwardly until the arm 310 of the presser bar lifting rod engages the transverse rod 301 to lift the transverse rod. As a result, the presser bar 102 and, accordingly, the presser foot moves upwardly against the force of the auxiliary spring 106.

Since the presser bar moves upwardly against the relatively weak force of the auxiliary spring and the resilient force of the presser spring is not applied to the presser bar, the presser foot can be lifted from the throat plate with a relatively small force provided by the operator's knee and held at any desired height above the throat plate.

Figure 3:
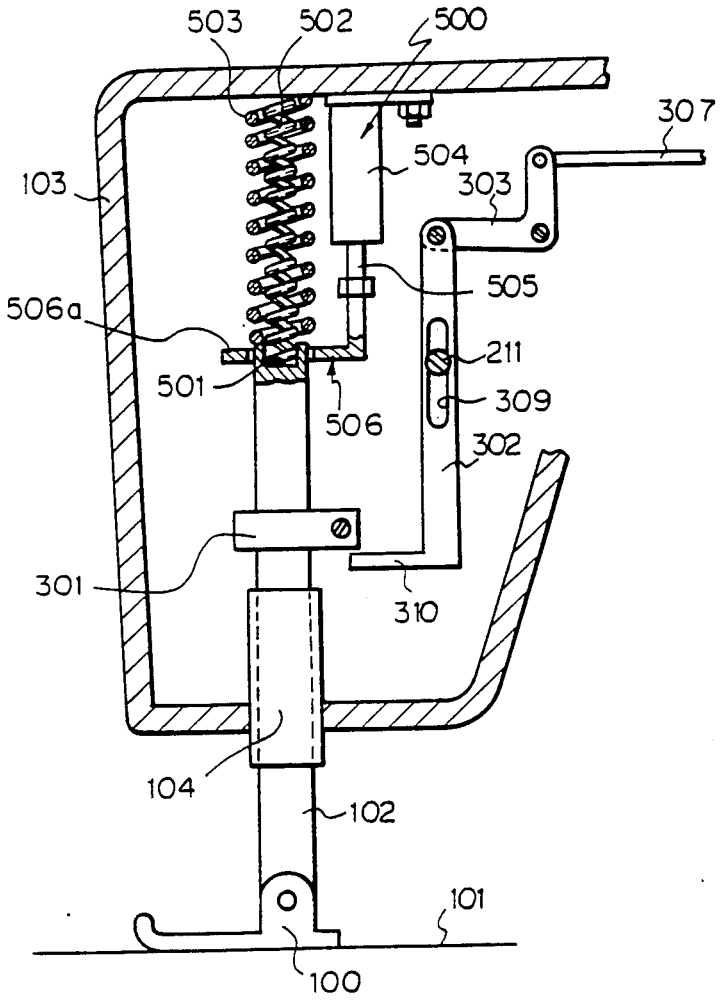
FIGS. 3 and 4 are elevational views in partial section of other embodiments of the present invention.

Referring now to FIG. 3, another embodiment of the present invention is illustrated. In this embodiment, a reciprocal solenoid 500 is employed in place of the rotary solenoid as the drive means for the pressure relief mechanism 200. In this embodiment, the spring means comprises an auxiliary spring 502 extending between a recessed bore 501 formed at the upper end of the presser bar and the inner wall of the machine frame 103 and a presser spring 503 surrounding the auxiliary spring and extending between the upper end of the presser bar and the machine frame. The force of the spring 503 is greater than that of the auxiliary spring 502. The cylinder 504 of the solenoid 500 is attached to the machine frame adjacent to the spring means. The piston rod 505 of the solenoid 500 has a substantially L-shaped member 506 attached to the leading end of the rod and one arm 506*a* of the member 506 faces the lower end of the presser spring 503.

In the embodiment shown in FIG. 3, when the knee abutment member 406 is pushed by the operator's knee to rotate the operation lever 401 in the counterclockwise direction in the same manner as was described in connection with the foregoing embodiment, the solenoid 500 is excited to move the piston rod 505 thereof upwardly and, accordingly, lifts the presser spring 503 at its lower end through the L-shaped member 506 whereby the presser spring can no longer act on the presser bar 102. Next, the presser foot drive mechanism operates in the same manner as described in connection with the foregoing embodiment.

Figure 4:
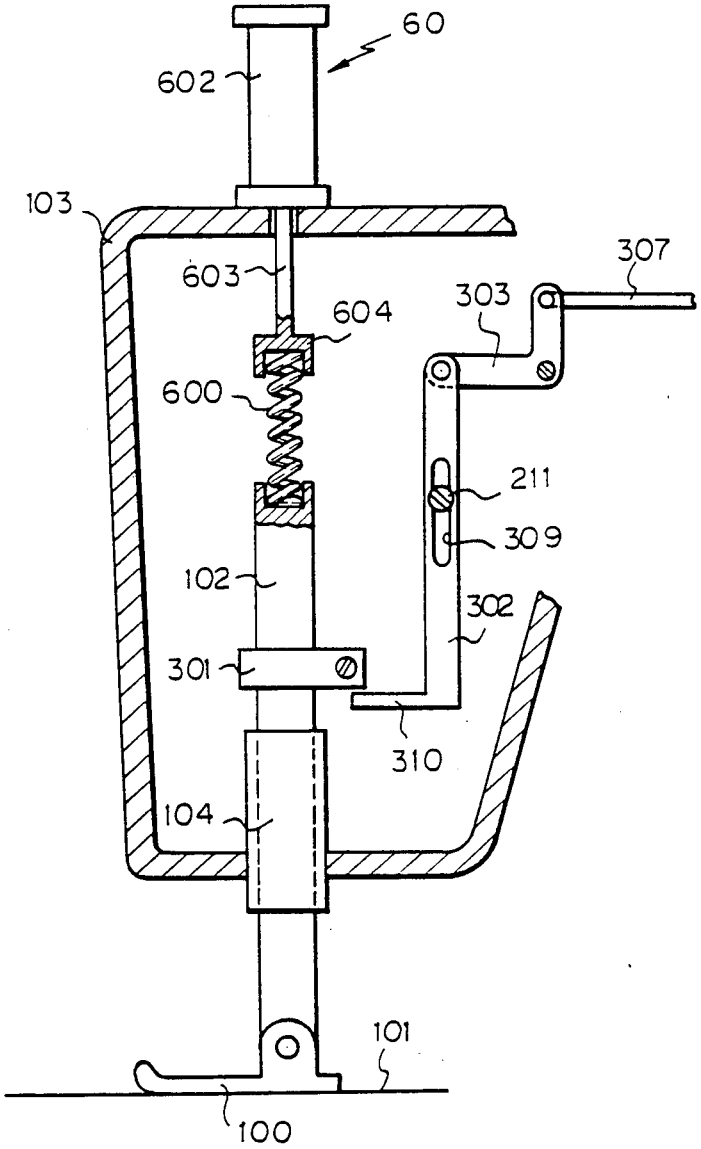

Referring now to FIG. 4, a further embodiment of the present invention is illustrated. In the embodiment shown in FIG. 4, the spring means comprising the two elements, that is, the presser and auxiliary springs in the foregoing embodiments is replaced by a single presser spring 600, while a reciprocal solenoid 601 is employed as the drive means for the pressure relief mechanism. The cylinder 602 of the solenoid is secured to the outer wall of the machine frame 103 and the piston rod 603 of the solenoid extends through the outer wall of the machine frame into the interior of the frame and has a spring holder 604 secured to the leading end thereof. The presser spring 600 extends between the spring holder 604 and presser bar 102.

When the operation mechanism 400 is not actuated or the limit switch 402 is in engagement with the undersurface of the oil pan 305, the piston rod 603 of the solenoid 601 extends to hold the presser spring 600 as shown in FIG. 4. Thus, the presser foot 100 is urged against the throat plate 101 under the resilient force of the presser spring. In the same manner as was described in connection with the foregoing embodiments, when the operation mechanism 400 is actuated, the limit switch 402 disengages from the undersurface of the oil pan 603 to excite the solenoid 601 which in turn moves the piston rod 603 of the solenoid 601 to allow the presser spring to be restored or to extend to its relaxed condition so that the resilient force of the spring is reduced. Thus, the force with which the presser foot 100 is urged against the throat plate 101 is lessened.

When the presser foot drive mechanism 300 is driven with the components maintained in the conditions just described, the presser foot 100 can be lifted to any desired height above the throat plate with a weak force.

The solenoid employed in any one of the foregoing embodiments can be replaced by an air cylinder and the operation lever in any one of the foregoing embodiments can also be replaced by a treadle.

From the foregoing description of the embodiments of the present invention, it will be apparent that the object of the present invention can be achieved.

According to the present invention, when the presser foot is lifted, the force with which the presser foot is urged against the throat plate can be reduced by the pressure relief mechanism and thus it is possible to realize the advantages of achieving substantial reduction in the fatigue experienced by the operator in lifting the presser foot and enabling the presser foot to be held at any height suitable for the thickness of the workpiece to be sewn.

I claim:

1. A sewing machine for use in sewing a workpiece, said sewing machine comprising a pressor foot movable between a lowered position in abutting engagement with the workpiece and a raised position, spring means for pressing said pressor foot against the workpiece when said presser foot is in the lowered position, said spring means being operable between a first condition in which said spring means presses said presser foot against the workpiece with a first spring force when said presser foot is in the lowered position and a second condition in which said spring means presses said presser foot against the workpiece with a second spring force when said presser foot is in the lowered position, said second spring force being less than said first spring force, operator means for operating said spring means from the first condition in which said spring means presses said presser foot against the workpiece with the first spring force to the second condition in which said spring means presses said presser foot against the workpiece with the second spring force while said presser foot is in the lowered position, and manually operable actuator means for effecting operation of said operator means to operate said spring means from the first condition to the second condition and for lifting said presser foot from the lowered position to the raised position against the second spring force in response to operation of said actuator means with said presser foot in the lowered position.

2. A sewing machine as set forth in claim 1 wherein said actuator means includes a member which is manually movable from a first position through a range of movement to a second position, means for effecting operation of said operator means to operate said spring means from the first condition to the second condition in response to movement of said member through an initial portion of the range of movement, and means for lifting said presser foot from the lowered position to the raised position against the second spring force in response to continued movement of said member through the range of movement.

3. A sewing machine as set forth in claim 2 wherein said means for lifting said presser foot includes a linkage interconnecting said presser foot and member, said linkage being operable by said member to move said presser foot from the lowered position to the raised position independently of said operator means.

4. A sewing machine as set forth in claim 3 wherein said operator means includes motor means for providing force to operate said spring means from the first condition to the second condition independently of said linkage means.

5. A sewing machine as set forth in claim 1 wherein said spring means includes first and second spring members which press said presser foot against the workpiece when said presser foot is in the lowered position and said spring means is in the first condition, said operator means including means for rendering said first spring member ineffective to press said presser foot against the workpiece when said presser foot is in the lowered position and said spring means is in the second condition.

6. A sewing machine as set forth in claim 5 wherein said actuator means is operable to raise said presser foot against the influence of said second spring member when said spring means is in the second condition.

7. A sewing machine as set forth in claim 1 wherein said spring means includes a single spring member, said operator means including means for reducing the spring force applied against said presser foot by said single spring member upon operation of said spring means from the first condition to the second condition.

8. A sewing machine as set forth in claim 7 wherein said single spring member is compressed through a relatively large distance when said spring means is in the first condition and is compressed through a relatively small distance when said spring means is in the second condition.

* * * * *